US010708686B2

(12) United States Patent
Maeno et al.

(10) Patent No.: US 10,708,686 B2
(45) Date of Patent: Jul. 7, 2020

(54) LOCAL SOUND FIELD FORMING APPARATUS AND LOCAL SOUND FIELD FORMING METHOD

(71) Applicant: SONY CORPORATION, Tokyo (JP)

(72) Inventors: Yu Maeno, Tokyo (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/301,087

(22) PCT Filed: May 17, 2017

(86) PCT No.: PCT/JP2017/018498
§ 371 (c)(1),
(2) Date: Nov. 13, 2018

(87) PCT Pub. No.: WO2017/208819
PCT Pub. Date: Dec. 7, 2017

(65) Prior Publication Data

US 2019/0191241 A1 Jun. 20, 2019

(30) Foreign Application Priority Data

May 30, 2016 (JP) ..... 2016-107355

(51) Int. Cl.
*H04R 3/00* (2006.01)
*H04R 1/40* (2006.01)
*H04R 3/12* (2006.01)

(52) U.S. Cl.
CPC ..... *H04R 1/403* (2013.01); *H04R 3/00* (2013.01); *H04R 3/005* (2013.01); *H04R 3/12* (2013.01)

(58) Field of Classification Search
CPC . H04R 3/00; H04R 3/005; H04R 3/12; H04R 5/00; H04R 5/02; H04R 1/403
See application file for complete search history.

(56) References Cited

U.S. PATENT DOCUMENTS 6,546,105 B1 * 4/2003 Katayama ..... H04R 5/00 381/1
6,674,864 B1 * 1/2004 Kitamura ..... H03G 5/005 381/103

(Continued)

FOREIGN PATENT DOCUMENTS

JP 2012-008156 A 1/2012
JP 2012-044572 A 3/2012

(Continued)

OTHER PUBLICATIONS

Itou, et al.,"Evanescent Wave Reproduction Using Linear Array of Loudspeakers", 2011 IEEE Workshop on Applications of Signal Processing to Audio and Acoustics, Oct. 16-19, 2011, 37-40 pages.

(Continued)

*Primary Examiner* — Thang V Tran
(74) *Attorney, Agent, or Firm* — Chip Law Group

(57) ABSTRACT

There is provided a local sound field forming apparatus including a local sound field forming filter coefficient recording unit that records an audio filter coefficient for forming a sound field by an evanescent wave, a filter unit that convolves the audio filter coefficient and a sound source signal to generate a loudspeaker drive signal, and a loudspeaker array that includes a plurality of loudspeakers including a directional loudspeaker, and that reproduces a sound on the basis of the loudspeaker drive signal. The present technology can be applied to a local sound field forming apparatus.

6 Claims, 13 Drawing Sheets

(56) References Cited

U.S. PATENT DOCUMENTS

2003/0142842 A1* 7/2003 Arai ..... A47C 7/72 381/300
2005/0117753 A1* 6/2005 Miura ..... H04R 3/12 381/17
2005/0141735 A1* 6/2005 Kim ..... H04S 1/002 381/313
2006/0050897 A1* 3/2006 Asada ..... H04R 3/12 381/98
2007/0147636 A1* 6/2007 Oteki ..... H04S 7/302 381/96
2007/0154019 A1* 7/2007 Kim ..... H04S 1/00 381/17
2008/0118074 A1* 5/2008 Takada ..... G01S 19/49 381/17
2008/0298611 A1* 12/2008 Nakamura ..... H04S 1/002 381/307
2009/0034745 A1* 2/2009 Mizuno ..... H04S 1/002 381/1
2011/0044467 A1* 2/2011 Pompei ..... H04R 5/02 381/77
2011/0051937 A1* 3/2011 Ma ..... H04R 5/02 381/17
2011/0274283 A1* 11/2011 Athanas ..... G10K 11/178 381/71.7
2012/0201405 A1* 8/2012 Slamka ..... H04S 7/306 381/307
2013/0039512 A1* 2/2013 Miyata ..... H04R 3/12 381/97
2014/0098980 A1* 4/2014 Kaetel ..... H04R 1/026 381/300
2014/0119550 A1* 5/2014 Ashcraft ..... G06F 3/167 381/59

FOREIGN PATENT DOCUMENTS

JP 2012-175679 A 9/2012
JP 2013016904 A * 1/2013
JP 5486567 B2 * 5/2014

OTHER PUBLICATIONS

Itou, et al.,"Study of Acoustic Evanescent Wave Reproduction using Linear Loudspeaker Array", 947-948 pages.
International Search Report and Written Opinion of PCT Application No. PCT/JP2017/018498, dated Aug. 1, 2017, 08 pages of ISRWO.
Itou, et al., "Study of Acoustic Evanescent Wave Reproduction Using Linear Loudspeaker Array", Report of the 2011 Spring Meeting, the Acoustical Society of Japan CD-ROM, Mar. 2011, pp. 947-948.
Itou, et al., "Evanescent Wave Reproduction Using Linear Array of Loudspeakers", 2011 IEEE Workshop on Applications of Signal Processing to Audio and Acoustics, Oct. 16-19, 2011, 04 pages.
Itou, et al., "Study of Acoustic Evanescent Wave Reproduction using Linear Loudspeaker Array", Mar. 2011, pp. 947-948.

* cited by examiner

LOCAL SOUND FIELD FORMING APPARATUS AND LOCAL SOUND FIELD FORMING METHOD

CROSS REFERENCE TO RELATED APPLICATIONS

This application is a U.S. National Phase of International Patent Application No. PCT/JP2017/018498 filed on May 17, 2017, which claims priority benefit of Japanese Patent Application No. JP 2016-107355 filed in the Japan Patent Office on May 30, 2016. Each of the above-referenced applications is hereby incorporated herein by reference in its entirety.

TECHNICAL FIELD

The present technology relates to a local sound field forming apparatus, a local sound field forming method, and a program. In particular, the present technology relates to a local sound field forming apparatus, a local sound field forming method, and a program that are capable of reducing sound leakage in an unintended direction.

BACKGROUND ART

In recent years, in public places such as airports and stations, operation information and signage are presented using a video display.

When content is presented in a public place in this way, it is possible to present the content more effectively by using audio in addition to video, but on the other hand, audio will reach an unspecified large number of people who do not need such information.

Therefore, a local sound field forming technique has been proposed, by which the reproduced sound can be heard only in the vicinity of a desired area, and can hardly be heard outside the area.

For example, as a method of forming such a local sound field, a local sound field forming method by means of super-directivity control using a parametric loudspeaker is known.

However, with the method by means of super-directivity control using a parametric loudspeaker, once a parametric loudspeaker is installed, it can only be used for fixed purposes, and some sort of ingenuity is also necessary for safety. Furthermore, since the frequency bands that can be used as reproduced sounds are limited, the reproduced contents are also restricted.

On the other hand, a method of realizing local sound field formation without restricting reproduced contents has also been proposed.

For example, as such a method, a method of generating an evanescent wave by using a loudspeaker array has been proposed (see, for example, Patent Document 1). Furthermore, in order to suppress space truncation errors due to a use of a finite length loudspeaker array for generating an evanescent wave, a method of reducing the errors by performing a windowing in the spatial direction has also been proposed (see, for example, Non-Patent Document 1).

By using the methods described in Patent Document 1 and Non-Patent Document 1, it is possible not only to form a local sound field without limiting reproduced contents, but also to form a local sound field in which leakage of propagating waves in a transverse direction with respect to the loudspeaker array can be suppressed to some extent.

CITATION LIST

Patent Document

Patent Document 1: Japanese Patent Application Laid-Open No. 2012-44572

Non-Patent Document

Non-Patent Document 1: Itou et al. "EVANESCENT WAVE REPRODUCTION USING LINEAR ARRAY OF LOUDSPEAKERS," in IEEE Workshop on Applications of Signal Processing to Audio and Acoustics (WASPAA), 2011.

SUMMARY OF THE INVENTION

Problems to be Solved by the Invention

However, with the above-described technique, sound leakage in an unintended direction cannot be sufficiently suppressed in some cases.

For example, in the case of performing content reproduction by using the techniques described in Patent Document 1 and Non-Patent Document 1, when the number of loudspeakers constituting the loudspeaker array is small or when a high frequency sound in the time frequency is reproduced, sound leakage in an unintended direction increases.

Doing so will create an area where people can hear the sound of the reproduced content outside the desired area as well, and the sound will reach other than the intended person.

The present technology has been made in view of such a situation, and it is intended to reduce sound leakage in an unintended direction.

Solutions to Problems

A local sound field forming apparatus according to one aspect of the present technology includes a local sound field forming filter coefficient recording unit configured to record an audio filter coefficient for forming a sound field by an evanescent wave, a filter unit configured to convolve the audio filter coefficient and a sound source signal to generate a loudspeaker drive signal, and a loudspeaker array that includes a plurality of loudspeakers including a directional loudspeaker, and is configured to reproduce a sound on the basis of the loudspeaker drive signal.

The directional loudspeaker may be a flat loudspeaker or a plane wave loudspeaker.

The loudspeaker array may be a linear loudspeaker array or a flat loudspeaker array.

At least half of the plurality of the loudspeakers included in the loudspeaker array may be the directional loudspeakers.

A local sound field forming method or a program, according to one aspect of the present technology, is a local sound field forming method or a program implemented by a local sound field forming apparatus including a local sound field forming filter coefficient recording unit configured to record an audio filter coefficient for forming a sound field by an evanescent wave, a filter unit configured to convolve the audio filter coefficient and a sound source signal to generate a loudspeaker drive signal, and a loudspeaker array that includes a plurality of loudspeakers including a directional loudspeaker, and is configured to reproduce a sound on the basis of the loudspeaker drive signal. The local sound field forming method or the program includes steps of generating the loudspeaker drive signal by the filter unit, and reproducing the sound on the basis of the loudspeaker drive signal by the loudspeaker array.

According to one aspect of the present technology, in a local sound field forming apparatus including a local sound field forming filter coefficient recording unit configured to record an audio filter coefficient for forming a sound field by an evanescent wave, a filter unit configured to convolve the audio filter coefficient and a sound source signal to generate a loudspeaker drive signal; and a loudspeaker array that includes a plurality of loudspeakers including a directional loudspeaker and is configured to reproduce a sound on the basis of the loudspeaker drive signal, the loudspeaker drive signal is generated by the filter unit, and the sound is reproduced on the basis of the loudspeaker drive signal by the loudspeaker array.

Effects of the Invention

According to one aspect of the present technology, sound leakage in an unintended direction can be reduced.

Note that the effects described herein are not necessarily limited, and any of the effects described in the present disclosure may be applied.

MODE FOR CARRYING OUT THE INVENTION

Hereinafter, an embodiment to which the present technology is applied will be described with reference to the drawings.

First Embodiment

<About Present Technology>

The present technology uses a loudspeaker array to form a local sound field which is a sound field where sound pressure sufficient for hearing is maintained only in the vicinity of the loudspeaker array and the sound pressure attenuates steeply in a distant area.

In the present technology, a loudspeaker array is used to form a local sound field and an evanescent wave is generated. An evanescent wave is a wave having a property that the sound pressure attenuates according to a distance exponentially in a direction perpendicular to the loudspeaker array.

If such an evanescent wave is used, the sound of the content can be reproduced such that sufficient sound pressure is maintained only in a desired area. However, in practice, the length of the loudspeaker array is finite. Then, sound may leak out in an unintended direction, practically.

Figure 1:
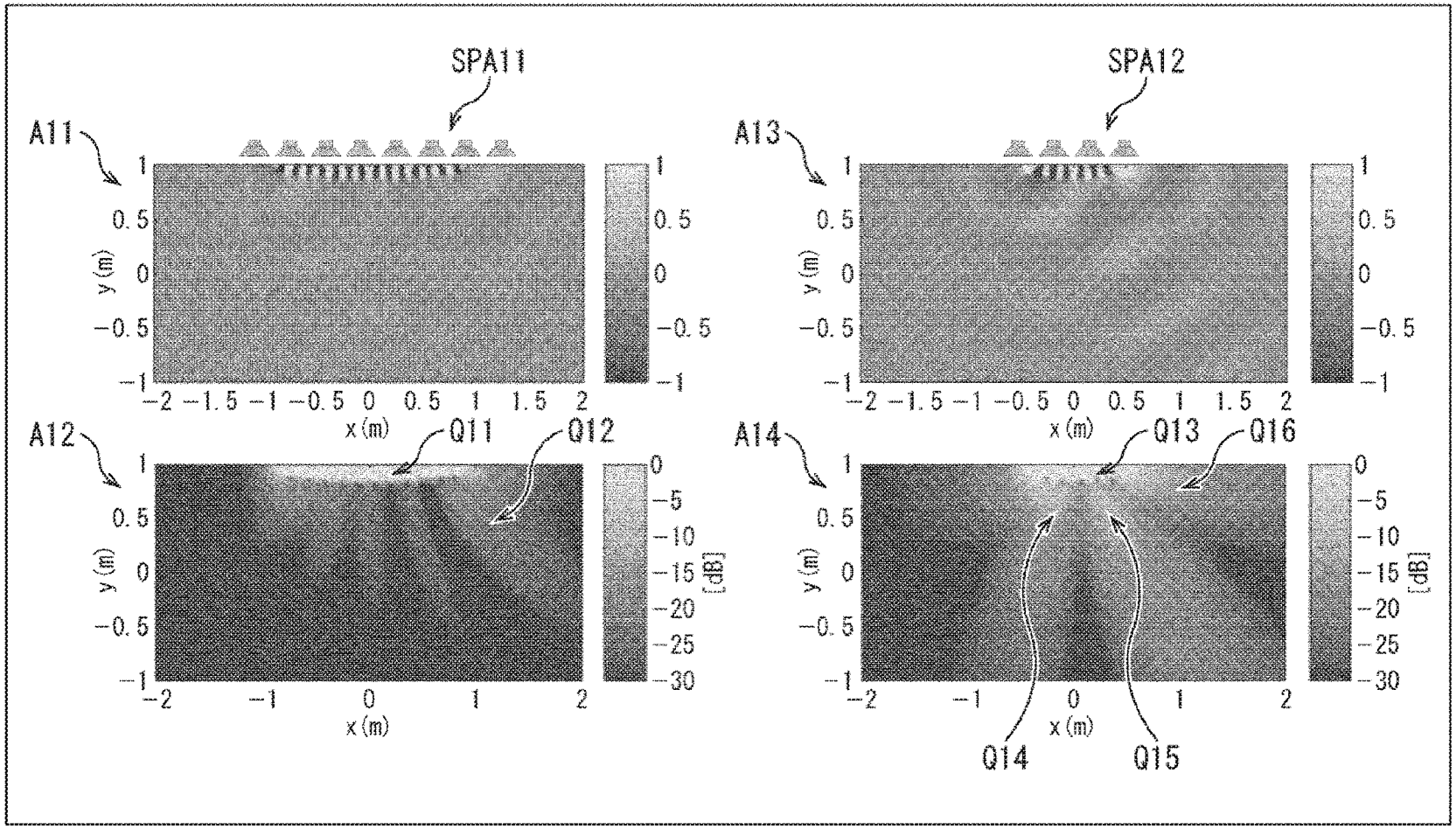
FIG. 1 is a diagram illustrating sound leakage depending on the number of loudspeakers.

It is known that such sound leakage increases as the number of loudspeakers constituting the loudspeaker array decreases as illustrated in FIG. 1, for example.

Note that in FIG. 1, the horizontal direction indicates a direction in which the loudspeakers of the loudspeaker array are arranged in a space, and this direction is also referred to as an x direction in the following description. Furthermore, in the drawing, the vertical direction indicates a direction perpendicular to the x direction in the space, and this direction is also referred to as a y direction in the following description. In particular, the y direction is a direction parallel to the direction in which the sound is output by the loudspeaker array.

In FIG. 1, a part indicated by an arrow A11 shows a state of the wave front of a sound in a space at a certain time when a sound field is formed by an evanescent wave using a loudspeaker array SPA11 configured of forty pieces of loudspeakers. Here, the density at each position indicates the amplitude of the sound wave.

Furthermore, a part indicated by an arrow A12 shows the sound pressure at each position in the space when the sound field indicated by the arrow A11 is formed by the loudspeaker array SPA11. In particular, the density at each position indicates the sound pressure.

In this example, it is understood that in an area indicated by an arrow Q11 in the vicinity of the loudspeaker array SPA11, for example, the sound pressure is large and it is possible to sufficiently hear the sound. On the other hand, it is understood that as the distance from the area indicated by the arrow Q11 increases, the sound pressure suddenly drops, the sound can hardly be heard, and a local sound field is formed. However, even in this case, in an area indicated by an arrow Q12, and elsewhere, for example, it is understood that sound leaks out slightly.

On the other hand, a part indicated by an arrow A13 in FIG. 1 shows a state of the wave front of a sound in a space at a certain time when a sound field is formed by an evanescent wave using a loudspeaker array SPA12 configured of twenty pieces of loudspeakers. Here, the density at each position indicates the amplitude of the sound wave.

Furthermore, a part indicated by an arrow A14 indicates the sound pressure at each position in the space when the sound field indicated by the arrow A13 is formed by the loudspeaker array SPA12. In particular, the density at each position indicates the sound pressure.

In this example, it is understood that the sound pressure is large in an area indicated by an arrow Q13 in the vicinity of the loudspeaker array SPA12, for example, so that it is possible to sufficiently hear the sound. On the other hand, while the sound pressure decreases in areas away from the area indicated by the arrow Q13, in an area indicated by an arrow Q14, an area indicated by an arrow Q15, and an area indicated by an arrow Q16, etc., for example, a larger amount of sound has leaked out compared with the case of the loudspeaker array SPA11.

In the case of forming a local sound field with an evanescent wave as described above, as the number of loudspeakers constituting a loudspeaker array decreases, sound leakage increases.

Figure 2:
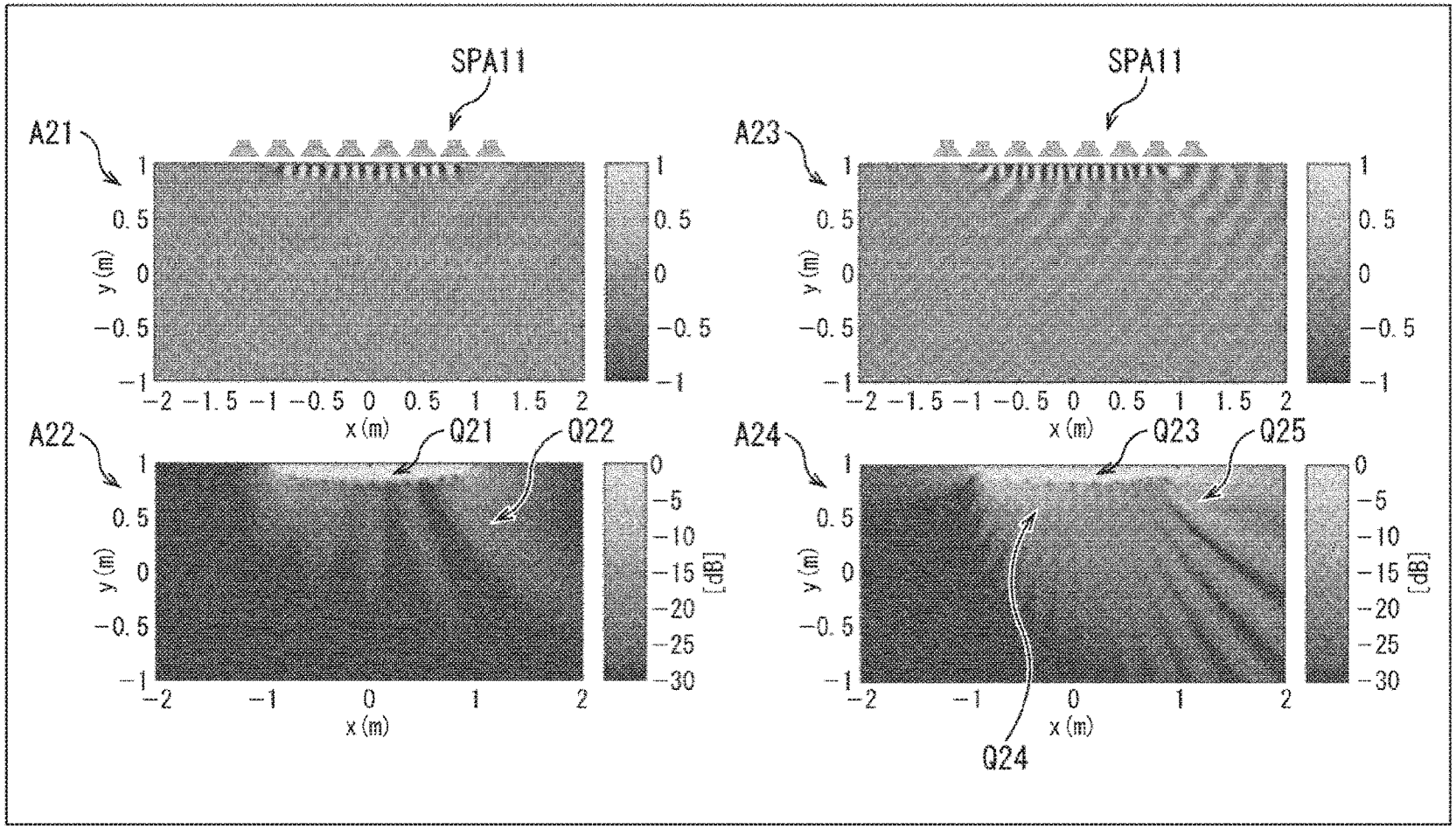
FIG. 2 is a diagram illustrating sound leakage depending on time frequency.

Moreover, sound leakage is increased not only by the number of loudspeakers of a loudspeaker array but also by the time frequency band of the sound to be reproduced, as illustrated in FIG. 2, for example.

Note that in FIG. 2, parts corresponding to those in FIG. 1 are denoted by the same reference numerals, and the description thereof will be omitted as appropriate. Furthermore, in FIG. 2, the horizontal direction indicates a direction in which the loudspeakers of the loudspeaker array SPA11 are arranged in the space, namely, the above-described x direction, and the vertical direction in the drawing indicates the above-described y direction.

In FIG. 2, a part indicated by an arrow A21 shows a state of the wave front of a sound in a space at a certain time when a sound field is formed by reproducing a sound having a time frequency of 500 Hz by an evanescent wave using the loudspeaker array SPA11. Here, the density at each position indicates the amplitude of the sound wave.

Furthermore, a part indicated by an arrow A22 shows the sound pressure at each position in the space when the sound field indicated by the arrow A21 is formed by the loudspeaker array SPA11. In particular, the density at each position indicates the sound pressure.

In this example, it is understood that the sound pressure is large in an area indicated by an arrow Q21 in the vicinity of the loudspeaker array SPA11, for example, so that it is possible to sufficiently hear the sound. On the other hand, it is understood that as the distance from the area indicated by the arrow Q21 increases, the sound pressure suddenly drops, and the sound can hardly be heard, and a local sound field is formed. However, also in this case, it is understood that the sound leaks out in an area indicated by an arrow Q22, and elsewhere, for example.

On the other hand, in FIG. 2, a part indicated by an arrow A23 shows a state of the wave front of a sound in a space at a certain time when a sound field is formed by reproducing a sound having a time frequency of 1500 Hz by an evanescent wave using the loudspeaker array SPA11. Here, the density at each position indicates the amplitude of the sound wave.

Furthermore, a part indicated by an arrow A24 shows the sound pressure at each position in the space when the sound field indicated by the arrow A23 is formed by the loudspeaker array SPA11. In particular, the density at each position indicates the sound pressure.

In this example, it is understood that the sound pressure is large in an area indicated by an arrow Q23 in the vicinity of the loudspeaker array SPA11, for example, so that it is possible to sufficiently hear the sound. On the other hand, the sound pressure decreases in areas away from the area indicated by the arrow Q23. However, in an area indicated by an arrow Q24, an area indicated by an arrow Q25, and elsewhere, for example, a larger amount of sound leaks out as compared with the case where sound of 500 Hz is reproduced.

In the case of forming a local sound field with an evanescent wave as described above, the higher the time frequency of the sound to be reproduced, that is, the higher the time frequency, the more the sound leakage occurs.

Therefore, in the present technology, by using a loudspeaker array including a directional loudspeaker in addition to signal processing at the time of generating a loudspeaker drive signal for generating an evanescent wave, it is possible to realize reduction of sound leakage in an unintended direction.

Here, a directional loudspeaker is, for example, a loudspeaker such as a flat loudspeaker, a plane wave loudspeaker, a parametric loudspeaker. It is a loudspeaker having a stronger directivity compared with a usual omnidirectional loudspeaker.

Figure 3:
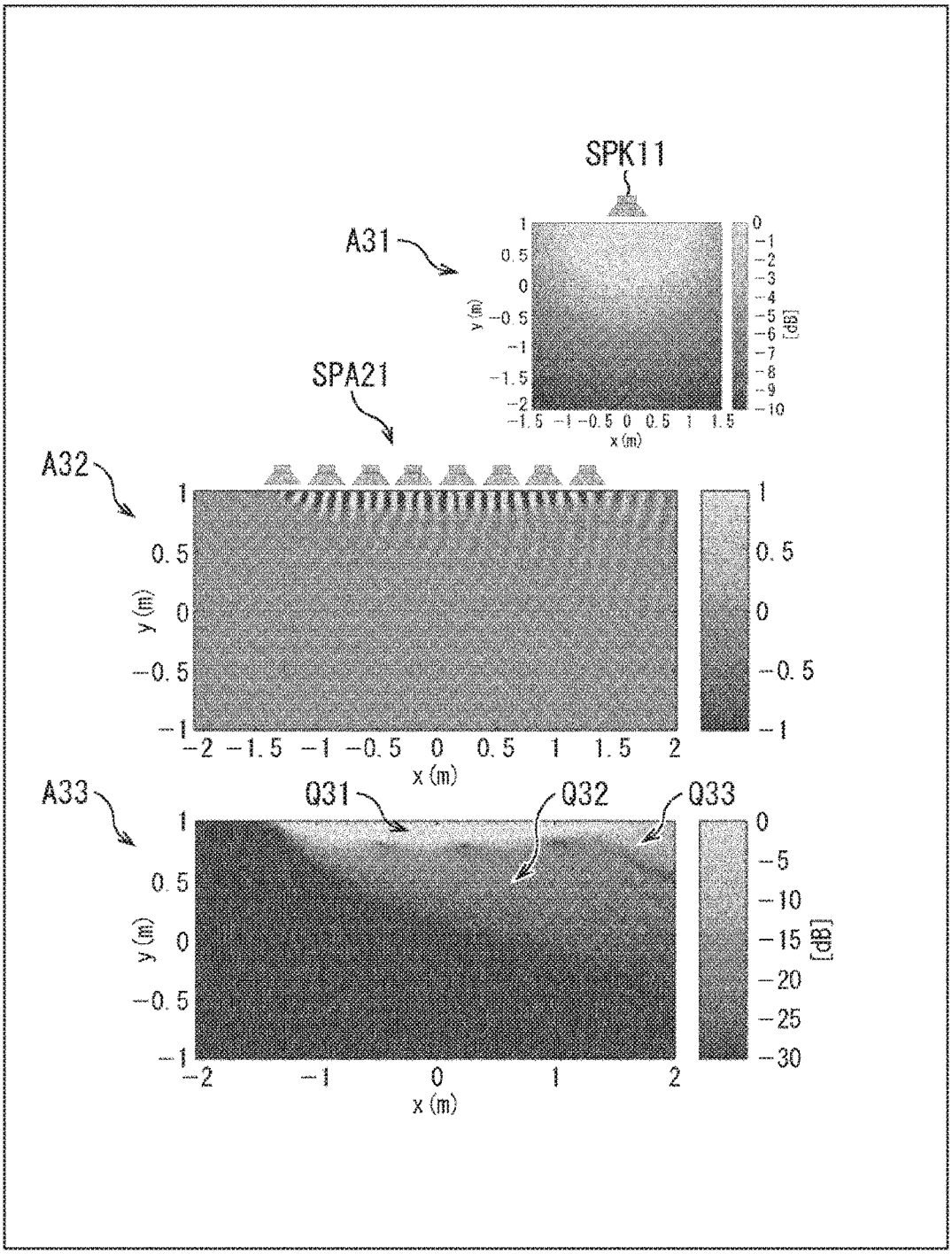
FIG. 3 is a diagram for explaining an omnidirectional loudspeaker.

Consideration will be given on the case where a sound field is formed by a loudspeaker array configured of an omnidirectional loudspeaker as illustrated in FIG. 3, for example. Note that in FIG. 3, the horizontal direction indicates the x direction in the space described above, and the vertical direction in the drawing indicates the y direction described above.

A part indicated by an arrow A31 shows the sound pressure at each position in a space when a sound is reproduced by using an omnidirectional loudspeaker SPK11. In particular, the density at each position indicates the sound pressure. As is understood from this example, in a case where a sound is reproduced by using the omnidirectional loudspeaker SPK11, the sound pressure in each direction becomes equal, and the wave front of the sound spreads and propagates in all directions.

A part indicated by an arrow A32 shows a state of the wave front of a sound in a space at a certain time when a sound field is formed by an evanescent wave using a loudspeaker array SPA21 obtained by arranging a plurality of loudspeakers similar to the omnidirectional loudspeaker SPK11. Here, the density at each position indicates the amplitude of the sound wave.

Furthermore, a part indicated by an arrow A33 shows the sound pressure at each position in the space when the sound field indicated by the arrow A32 is formed by the loudspeaker array SPA21. In particular, the density at each position indicates the sound pressure.

In this example, it is understood that the sound pressure is large in an area indicated by an arrow Q31 in the vicinity of the loudspeaker array SPA21, for example, so that it is possible to sufficiently hear the sound. On the other hand, when the distance from the area indicated by the arrow Q31 increases, the sound pressure suddenly drops, the sound can hardly be heard, and a local sound field is formed.

However, it is understood that the sound leaks out in an area indicated by an arrow Q32, an area indicated by the arrow Q33, and elsewhere, for example. In particular, it is understood that a large amount of sound leaks out in an area on the x direction side in the vicinity of the loudspeaker array SPA21, such as an area indicated by the arrow Q33.

Figure 4:
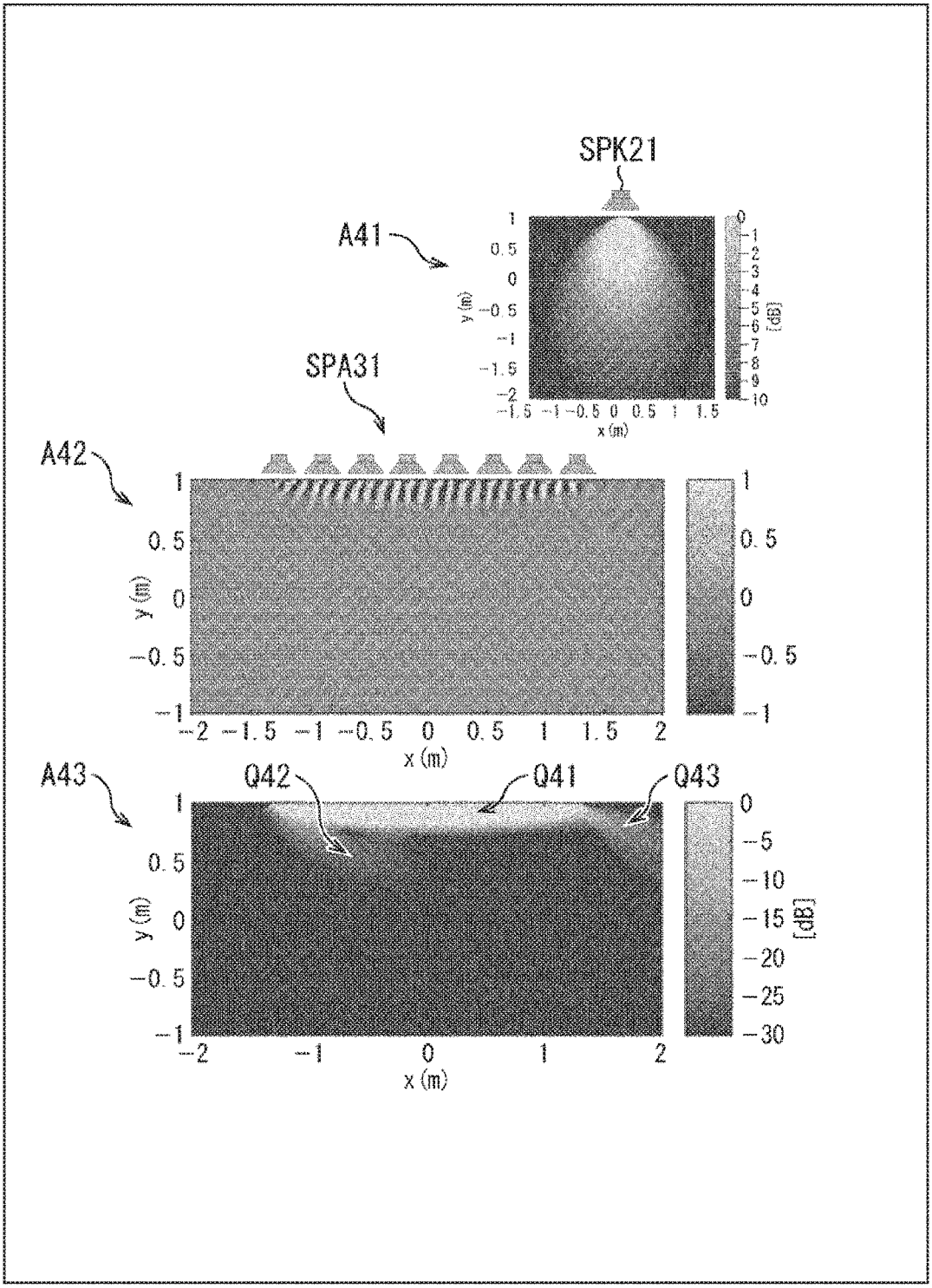
FIG. 4 is a diagram for explaining a directional loudspeaker.

Meanwhile, consideration will be given on the case where a sound field is formed by a loudspeaker array configured of a directional loudspeaker as illustrated in FIG. 4, for example. Note that in FIG. 4, the horizontal direction indicates the x direction in the space described above, and the vertical direction in the drawing indicates the y direction described above.

A part indicated by an arrow A41 shows the sound pressure at each position in a space when a sound is reproduced by using a directional loudspeaker SPK21. In particular, the density at each position shows the sound pressure. As is understood from this example, in a case where the sound is reproduced by using the directional loudspeaker SPK21, the sound pressure ahead of the directional loudspeaker SPK21 is large and the sound pressure on the right side and the left side of the directional loudspeaker SPK21 is extremely low. Accordingly, a sound wave having strong directivity is propagated.

A part indicated by an arrow A42 shows a state of the wave front of a sound in a space at a certain time when a sound field is formed by an evanescent wave using a loudspeaker array SPA31 obtained by arranging a plurality of loudspeakers similar to the directional loudspeaker SPK21. Here, the density at each position indicates the amplitude of the sound wave.

Furthermore, a part indicated by an arrow A43 shows the sound pressure at each position in the space when the sound field shown by the arrow A42 is formed by the loudspeaker array SPA31. In particular, the density at each position indicates the sound pressure.

In this example, it is understood that the sound pressure is large in an area indicated by an arrow Q41 in the vicinity of the loudspeaker array SPA31, for example, so that it is possible to sufficiently hear the sound. On the other hand, when the distance from the area indicated by the arrow Q41 increases, the sound pressure suddenly drops, the sound can hardly be heard, and a local sound field is formed.

Even when the loudspeaker array SPA31 configured of a directional loudspeaker is used, the sound leaks out in the area indicated by the arrow Q42, in the area indicated by the arrow Q43, and elsewhere, for example. However, compared with the example described with reference to FIG. 3, it is understood that sound leakage is very small.

By using the loudspeaker array SPA31 configured of such a directional loudspeaker, a local sound field in which sound leakage is sufficiently suppressed can be formed even in a case where the number of loudspeakers is small as described above or in a case where a high frequency sound is reproduced.

In other words, according to the present technology, by reducing the sound leakage sufficiently, it is possible to reduce the number of loudspeakers and to expand the time frequency band that can be reproduced in a state where sound leakage is sufficiently small to a higher frequency.

Figure 5:
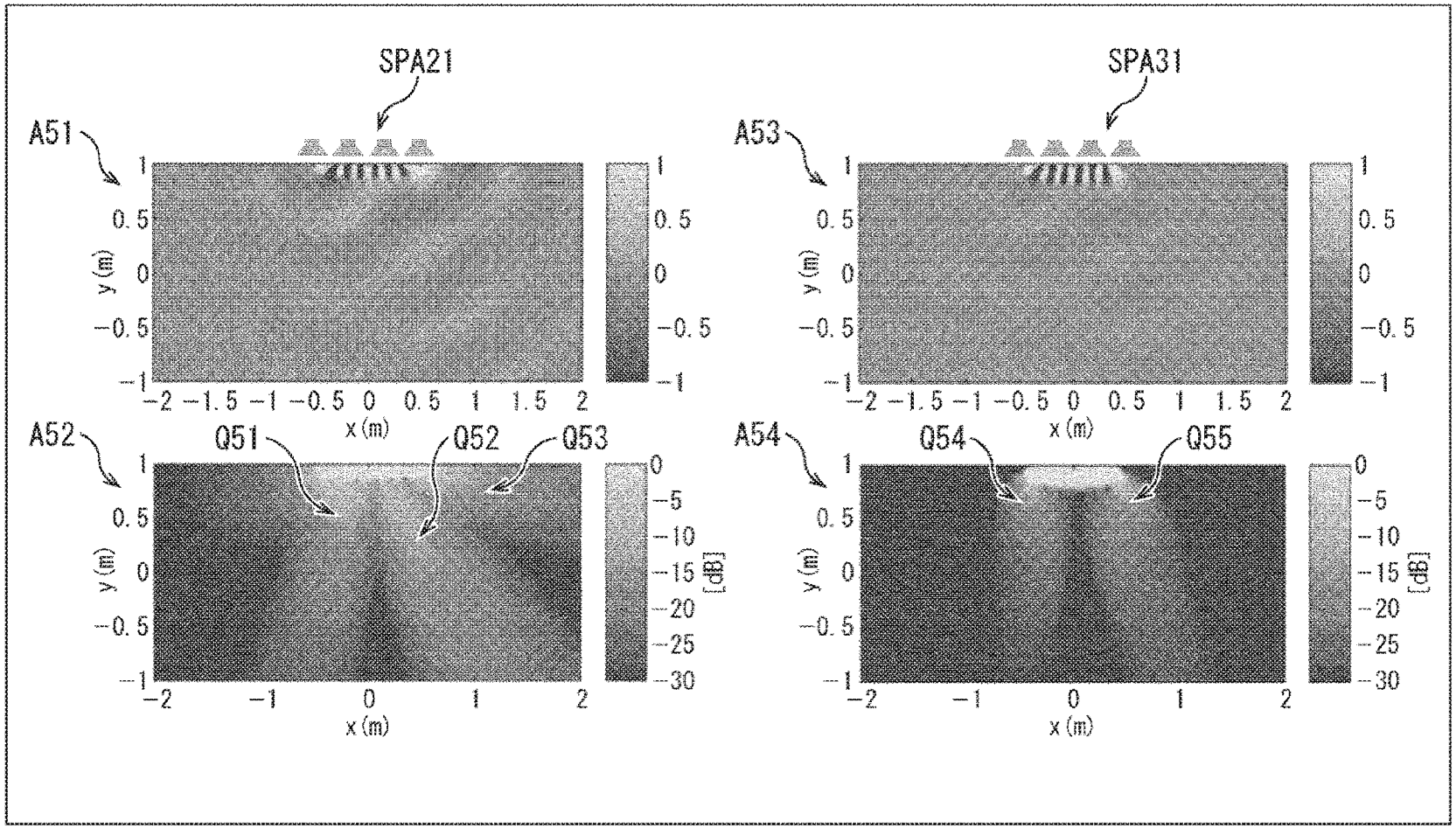
FIG. 5 is a diagram for explaining a reduction in the number of loudspeakers.

For example, when comparing the loudspeaker array SPA21 illustrated in FIG. 3 with the loudspeaker array SPA31 illustrated in FIG. 4, in a case where the number of loudspeakers is twenty and the time frequency of the sound to be reproduced is 500 Hz, the sound leak condition is as illustrated in FIG. 5.

Note that in FIG. 5, parts corresponding to those in FIG. 3 or FIG. 4 are denoted by the same reference numerals, and description thereof is omitted. Furthermore, in FIG. 5, the horizontal direction indicates the direction in which the loudspeakers of the loudspeaker array SPA21 or the loudspeaker array SPA31 in the space are arranged, namely, the above-described x direction, and the vertical direction in the drawing indicates the above-described y direction.

In FIG. 5, a part indicated by an arrow A51 shows a state of the wave front of a sound in a space at a certain time when a sound field is formed by reproducing the sound having a time frequency of 500 Hz by an evanescent wave using the loudspeaker array SPA21. Here, the loudspeaker array SPA21 is configured of twenty pieces of omnidirectional loudspeakers, and the density at each position indicates the amplitude of the sound wave.

Furthermore, a part indicated by an arrow A52 shows the sound pressure at each position in the space when the sound field indicated by the arrow A51 is formed by the loudspeaker array SPA21. In particular, the density at each position indicates the sound pressure.

In this example, an area in the vicinity of the loudspeaker array SPA21 is an area in which the sound is desired to be reproduced in a local sound field. However, the sound leaks out not only to the vicinity of the area where the sound is desired to be reproduced, such as areas indicated by arrows Q51 to Q53, for example, but also to an area relatively far from the desired area.

On the other hand, a part indicated by an arrow A53 shows a state of the wave front of a sound in a space at a certain time when a sound field is formed by reproducing the sound having a time frequency of 500 Hz by an evanescent wave using the loudspeaker array SPA31. Here, the loudspeaker array SPA31 is configured of twenty pieces of directional loudspeakers, and the density at each position indicates the amplitude of sound waves.

Furthermore, a part indicated by an arrow A54 shows the sound pressure at each position in the space when a sound field indicated by an arrow A53 is formed by the loudspeaker array SPA31. In particular, the density at each position indicates the sound pressure.

In this example, an area in the vicinity of the loudspeaker array SPA31 is an area where the sound is desired to be reproduced in the local sound field. However, the sound leaks out in the vicinity of the area where the sound is desired to be reproduced, such as areas indicated by an arrow Q54 and an arrow Q55, for example. However, it is understood that in a case where the loudspeaker array SPA31 is used, sound leakage is greatly reduced as compared with the case of using the loudspeaker array SPA21. In other words, it is understood that even when the loudspeaker array is configured of the relatively small number of loudspeakers, sound leakage in an unintended direction can be sufficiently suppressed.

Figure 6:
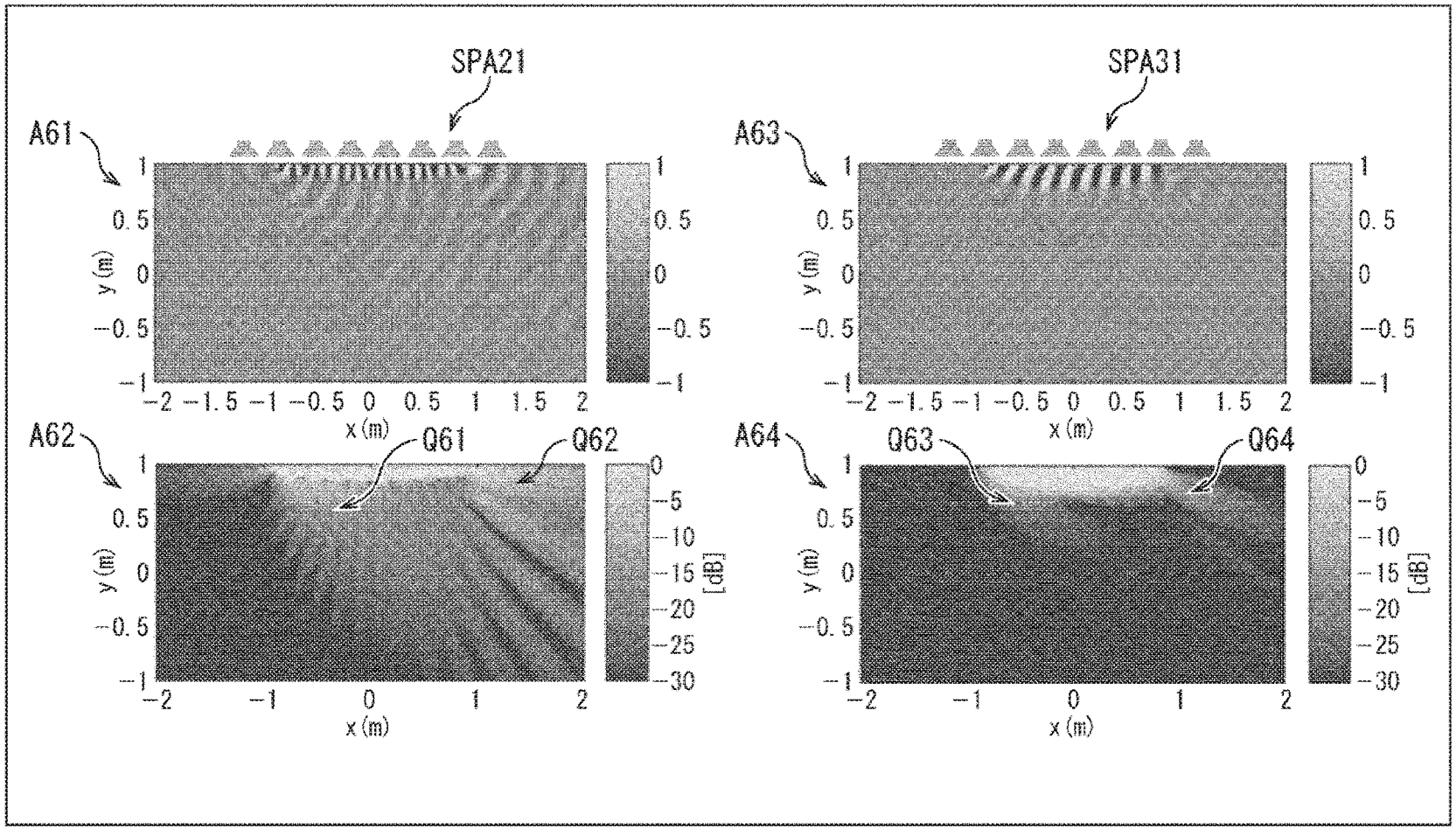
FIG. 6 is a diagram for explaining reproduction of a high frequency sound with respect to time frequency.

Similarly, in the case of comparing the loudspeaker array SPA21 and the loudspeaker array SPA31, for example, when the number of loudspeakers is forty and the time frequency of the sound to be reproduced is 1500 Hz, the state of sound leakage becomes as illustrated in FIG. 6.

Note that in FIG. 6, parts corresponding to those in the case of FIG. 5 are denoted by the same reference numerals, and the description thereof is omitted. Furthermore, in FIG. 6, the horizontal direction indicates the direction in which the loudspeakers of the loudspeaker array SPA21 or the loudspeaker array SPA31 in the space are arranged, namely, the above-described x direction, and the vertical direction in the drawing indicates the above-described y direction.

In FIG. 6, a part indicated by an arrow A61 shows a state of the wave front of a sound in a space at a certain time when a sound field is formed by reproducing a sound having a time frequency of 1500 Hz by an evanescent wave using the loudspeaker array SPA21. Here, the loudspeaker array SPA21 is configured of forty pieces of omnidirectional loudspeakers, and the density at each position indicates the amplitude of the sound wave.

Furthermore, a part indicated by an arrow A62 shows the sound pressure at each position in the space when the sound field indicated by the arrow A61 is formed by the loudspeaker array SPA21. In particular, the density at each position indicates the sound pressure.

In this example, an area in the vicinity of the loudspeaker array SPA21 is an area in which the sound is desired to be reproduced in a local sound field. However, the sound leaks out not only in areas in the vicinity of the area where the sound is desired to be reproduced such as areas indicated by an arrow Q61 and an arrow Q62, for example, but also in a wide area up to areas in a relatively far location.

On the other hand, a part indicated by an arrow A63 shows a state of the wave front of a sound in a space at a certain time when a sound field is formed by reproducing a sound having the time frequency of 1500 Hz by an evanescent wave using the loudspeaker array SPA31. Here, the loudspeaker array SPA31 is configured of forty pieces of directional loudspeakers, and the density at each position indicates the amplitude of the sound waves.

Furthermore, a part indicated by an arrow A64 shows the sound pressure at each position in the space when the sound field indicated by the arrow A63 is formed by the loudspeaker array SPA31. In particular, the density at each position indicates the sound pressure.

In this example, an area in the vicinity of the loudspeaker array SPA31 is an area where the sound is desired to be reproduced in the local sound field. However, the sound leaks out in the vicinity of the area where sound is desired to be reproduced, such as areas indicated by an arrow Q63 and an arrow Q64, for example. However, it is understood that in a case where the loudspeaker array SPA31 is used, sound leakage is greatly reduced as compared with the case of using the loudspeaker array SPA21. In other words, it is understood that sound leakage in an unintended direction can be sufficiently suppressed even when a high frequency sound is reproduced.

With the present technology as described above, by forming a local sound field by combining an loudspeaker array including directional loudspeakers and signal processing at the time of generating a loudspeaker drive signal for generating an evanescent wave, it is possible to reduce sound leakage in an unintended direction. In particular, with the present technology, sound leakage can be sufficiently suppressed even in a case where the number of loudspeakers of a loudspeaker array is small or the case where a high frequency sound is reproduced.

Note that in the example described with reference to FIGS. 4 to 6, the case where the loudspeakers constituting the loudspeaker array are all directional loudspeakers has been described. However, it is sufficient that at least a part of the loudspeakers constituting the loudspeaker array is a directional loudspeaker.

For example, in a case where a loudspeaker array is configured by combining directional loudspeakers and omnidirectional loudspeakers, the right half of the loudspeaker array may be configured of a plurality of omnidirectional loudspeakers, and the remaining left half may be configured of a plurality of directional loudspeakers. Furthermore, directional loudspeakers and omnidirectional loudspeakers may be alternately arranged to form a loudspeaker array, for example.

<Exemplary Configuration of Local Sound Field Forming Apparatus>

Subsequently, a more specific embodiment of the present technology described above will be described.

Figure 7:
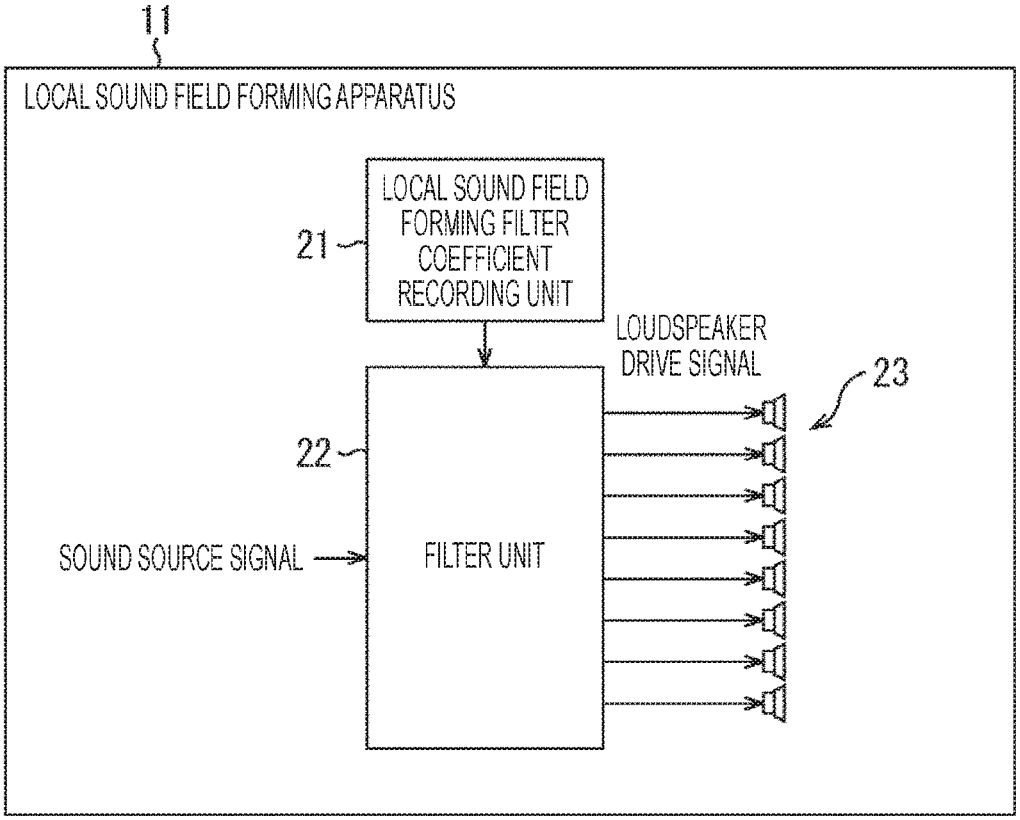
FIG. 7 is a diagram illustrating a configuration of a local sound field forming apparatus.

FIG. 7 is a diagram illustrating an exemplary configuration of a local sound field forming apparatus to which the present technology is applied.

A local sound field forming apparatus 11 illustrated in FIG. 7 includes a local sound field forming filter coefficient recording unit 21, a filter unit 22, and a loudspeaker array 23.

The local sound field forming filter coefficient recording unit 21 includes a nonvolatile memory or the like, for example, and records, in advance, coefficients of an audio filter for forming a local sound field by generating an evanescent wave to form a sound field. In other words, the audio filter coefficients recorded in the local sound field forming filter coefficient recording unit 21 are filter coefficients for a local sound field forming filter for forming a desired sound field by an evanescent wave.

The local sound field forming filter coefficient recording unit 21 supplies the recorded audio filter coefficients to the filter unit 22.

The filter unit 22 is supplied with a sound source signal which is a sound signal of a sound forming a local sound field by the loudspeaker array 23. The filter unit 22 applies, to the supplied sound source signal, a filtering process using the audio filter coefficient supplied from the local sound field forming filter coefficient recording unit 21, to thereby generate a loudspeaker drive signal for forming a local sound field by the loudspeaker array 23. The filter unit 22 supplies the loudspeaker drive signals of the respective loudspeakers thus obtained to the loudspeaker array 23 to reproduce the sound.

The loudspeaker array 23 is configured of a linear loudspeaker array obtained by linearly arranging a plurality of loudspeakers, a flat loudspeaker array obtained by arranging a plurality of loudspeakers on a plane, or the like, and reproduces the sound on the basis of the loudspeaker drive signal supplied from the filter unit 22.

Thus, an evanescent wave is generated by the loudspeaker array 23, and a local sound field is formed in which the sound can be heard only in an area in the vicinity of the loudspeaker array 23.

Note that although the loudspeaker array 23 is configured of a plurality of loudspeakers, at least one of the plurality of loudspeakers is a directional loudspeaker such as a flat loudspeaker, a plane wave loudspeaker, or a parametric loudspeaker, as described above. That is, part or all of the loudspeakers constituting the loudspeaker array 23 are directional loudspeakers.

For example, at least half of the loudspeakers constituting the loudspeaker array 23 may be directional loudspeakers such as flat loudspeakers and plane wave loudspeakers.

(Local Sound Field Forming Filter Coefficient Recording Unit)

Next, respective units of the local sound field forming apparatus 11 will be described in more detail.

First, the local sound field forming filter coefficient recording unit 21 will be described.

For example, description will be given below on the case where a predetermined position V of a sound field in a three-dimensional free space is described in a three-dimensional orthogonal coordinate system illustrated in FIG. 8.

Figure 8:
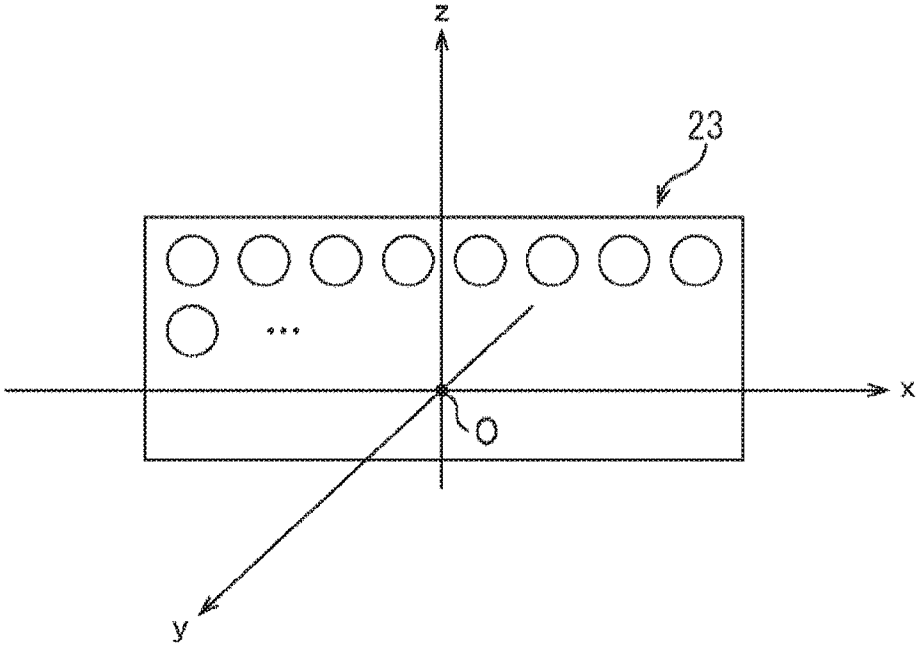
FIG. 8 is a diagram for explaining a coordinate system.

In the example illustrated in FIG. 8, the loudspeaker array 23 is a flat loudspeaker array, and a predetermined position on the flat loudspeaker array is set as an origin O of the xyz coordinate system which is a three-dimensional orthogonal coordinate system. Furthermore, in the xyz coordinate system, the horizontal direction in the drawing is an x axis direction (x direction), the front direction in the drawing is a y axis direction (y direction), and the vertical direction in the drawing is a z axis direction (z direction).

Therefore, in this example, an arbitrary position V is expressed as a position V=(x,y,z) using the x coordinate, the y coordinate, and the z coordinate.

In particular, in this example, the y direction is a direction perpendicular to the direction in which the loudspeakers constituting the loudspeaker array 23 are lined up, and when a local sound field is formed, a sound is reproduced by the loudspeaker array 23 such that an evanescent wave that attenuates in the y direction is generated.

In the local sound field forming filter coefficient recording unit 21, filter coefficients of an audio filter for generating, by the loudspeaker array 23, an evanescent wave to be attenuated in the y direction are recorded. For example, filter coefficients constituting the audio filter are obtained as described below.

In other words, in the three-dimensional free space, a sound field p(V,t) at a time t at an arbitrary position V satisfies a wave expression shown by the following Expression (1).

[Math. 1]

$$\nabla^2 p(V,t) - \frac{1}{c^2}\frac{\partial^2 p(V,t)}{\partial t^2} = 0 \tag{1}$$

Note that in Expression (1), c represents the speed of sound, and $\nabla^2$ is as shown by the following Expression (2).

[Math. 2]

$$\nabla^2 = \frac{\partial^2}{\partial x^2} + \frac{\partial^2}{\partial y^2} + \frac{\partial^2}{\partial z^2} \tag{2}$$

Furthermore, assuming that the inverse time Fourier transform T(t) is shown by the following Expression (3), the time Fourier transform F(•) is as shown by the following Expression (4).

[Math. 3]

$$T(t) = \frac{1}{2\pi}\int_{-\infty}^{\infty} \overline{T}(\omega)e^{i\omega T}d\omega \tag{3}$$

[Math. 4]

$$F\left(\frac{\partial^2 T(t)}{\partial t^2}\right) = (i\omega)^2\overline{T}(\omega) \tag{4}$$

Note that in Expressions (3) and (4), i represents an imaginary unit, and ω represents an angular frequency.

Here, with respect to Expression (1) described above, variable division is performed as expressed in the following Expression (5) to divide the space differential and the time differential. Further, by using Expression (4), Helmholtz expression shown by the following Expression (6) is obtained.

[Math. 5]

$$p(V,T) = X(V)T(t) \tag{5}$$

[Math. 6]

$$\nabla^2 P(V,\omega) + \left(\frac{\omega}{c}\right)^2 P(V,\omega) = 0 \tag{6}$$

Note that in Expression (6), P(V,ω) represents the sound field of the angular frequency co at the position V. Furthermore, when the angular frequency is ($\omega_{pw}$, and the wave numbers in the x direction, the y direction, and the z direction are $k_{pw,x}$, $k_{pw,y}$, and $k_{pw,z}$, respectively, the general solution of the Helmholtz expression shown by Expression (6), representing the plane wave propagating in a direction represented by the angular frequency $\omega_{pw}$, the wave number $k_{pw,x}$, the wave number $k_{pw,y}$, and the wave number $k_{pw,z}$ is as expressed in the following Expression (7).

[Math. 7]

$$P(V,\omega) = 2\pi\delta(\omega-\omega_{pw})e^{-(k_{pw,x}X+k_{pw,y}y+k_{pw,z}Z)} \tag{7}$$

Note that in Expression (7), $\delta(\omega-\omega_{pw})$ represents a delta function.

Here, in the wave number area, the relationship shown by the following Expression (8) is established.

[Math. 8]

$$\left(\frac{\omega}{c}\right)^2 = k_{pw,x}^2 + k_{pw,y}^2 + k_{pw,z}^2 \tag{8}$$

Solving Expression (8) for the wave number $k_{pw,y}$ in the y direction yields the following Expression (9).

[Math. 9]

$$k_{pw,y} = \begin{cases} \pm\sqrt{\left(\frac{\omega}{c}\right)^2 - k_{pw,x}^2 - k_{pw,z}^2} & \text{for } \sqrt{k_{pw,x}^2 + k_{pw,z}^2} < \left|\frac{\omega}{c}\right| \\ \pm i\sqrt{k_{pw,x}^2 + k_{pw,z}^2 - \left(\frac{\omega}{c}\right)^2} & \text{for } \left|\frac{\omega}{c}\right| < \sqrt{k_{pw,x}^2 + k_{pw,z}^2} \end{cases} \tag{9}$$

The wave in the upper part of Expression (9), that is, the wave with the wave number $k_{pw,y}$ shown in the upper part, represents a normal propagating wave, and the wave in the lower part of Expression (9), that is, the wave with the wave number shown in the lower part, represents an evanescent wave.

Therefore, substituting the wave number $k_{pw,y}$ of the evanescent wave shown in the lower part of Expression (9) into the sound field P(V,ω) shown in Expression (7) results in the following Expression (10).

[Math. 10]

$$P(V,\omega) = 2\pi\delta(\omega-\omega_{pw})e^{-\sqrt{k_{pw,x}^2+k_{pw,z}^2-\left(\frac{\omega}{c}\right)^2}\,y}e^{-i(k_{pw,x}x+k_{pw,z}z)} \tag{10}$$

However, when substituting the wave number $k_{pw,y}$ into Expression (7), since the term having a positive sign of the wave number $k_{pw,y}$ provides a physically meaningless solution, a term having a negative sign is substituted.

Furthermore, $(k_{pw,x}^2+k_{pw,z}^2-(\omega/c)^2)^{1/2}$ in Expression (10) is a term that defines the magnitude of attenuation of the evanescent wave.

Therefore, in a case where it is desired to have a constant attenuation magnitude without depending on the angular frequency ω, for example, the wave number $k_{pw,x}$ and the wave number $k_{pw,z}$ may be set so as to satisfy the following Expression (11) using a constant α representing the magnitude of attenuation. At this time, as is understood from Expression (10), the attenuation factor of the evanescent wave increases as the constant α increases.

[Math. 11]

$$\alpha = \sqrt{k_{pw,x}^2 + k_{pw,z}^2 - \left(\frac{\omega}{c}\right)^2} \tag{11}$$

Here, it is considered to obtain a coefficient of an audio filter for obtaining a loudspeaker drive signal for generating the evanescent wave expressed by Expression (10). Note that how to obtain the coefficient of the audio filter is also described in detail, for example, in "Itou et al. "EVANESCENT WAVE REPRODUCTION USING LINEAR ARRAY OF LOUDSPEAKERS" in IEEE Workshop on Applications of Signal Processing to Audio and Acoustics (WASPAA), 2011", and the like.

When Expression (10) is subjected to spatial Fourier transformation on x, it is expressed as shown in the following Expression (12).

[Math. 12]

$$P'(k_x,y,z,\omega)=4\pi^2\delta(\omega-\omega_{pw})\delta(k_x-k_{pw,x})e^{-\alpha y}e^{-ik_{pw,z}z} \tag{12}$$

Furthermore, a spatial frequency spectrum $G'(k_x,y,z,\omega)$ of the transfer function is expressed as shown in the following Expression (13).

[Math. 13]

$$G'(k_x, y, z, \omega) = \begin{cases} -\frac{i}{4}H_0^{(2)}\left(\sqrt{\left(\frac{\omega}{c}\right)^2 - k_x^2}\sqrt{y^2+z^2}\right) & \text{for } |k_x| \le \left|\frac{\omega}{c}\right| \\ \frac{1}{2\pi}K_0\left(\sqrt{k_x^2 - \left(\frac{\omega}{c}\right)^2}\sqrt{y^2+z^2}\right) & \text{for } |k_x| > \left|\frac{\omega}{c}\right| \end{cases} \tag{13}$$

Note that in Expression (13), $H_0^{(2)}$ represents a second-type Hankel function, and $K_0$ represents a Bessel function.

Moreover, from the spectral division method (SDM), the spatial frequency spectrum $D'(k_x,\omega)$ of the loudspeaker drive signal is as shown in the following Expression (14). Note that the SDM method is described in detail, for example, in "Jens Ahrens and Sascha Spors, "Sound Field Reproduction Using Planar and Linear Arrays of loudspeakers," in IEEE TRANSACTIONS ON AUDIO, SPEECH, AND LANGUAGE PROCESSING, VOL. 18, NO. 8, November 2010", and the like.

[Math. 14]

$$D'(k_x, \omega) = \frac{8\pi^3 e^{-\alpha y_{ref}} e^{-ik_{pw,z}z}}{K_0(\alpha y_{ref})}\delta(\omega-\omega_{pw})\delta(k_x-k_{pw,x}) \tag{14}$$

In Expression (14), $y_{ref}$ represents a reference position serving as a basis in the y direction, namely a position of a control point.

By performing inverse spatial Fourier transformation on Expression (14) thus obtained with respect to the wave number $k_x$, the time frequency spectrum $D(x,\omega)$ of the loudspeaker drive signal shown in the following Expression (15) is obtained.

[Math. 15]

$$D(x, \omega) = \frac{4\pi^2 e^{-\alpha y_{ref}} e^{-ik_{pw,z}z}}{K_0(\alpha y_{ref})}\delta^{-ik_{pw,x}x}\delta(\omega-\omega_{pw}) \tag{15}$$

Moreover, when the time frequency spectrum $D(x,\omega)$ thus obtained is subjected to inverse time Fourier transform, the time waveform d(x,t) of the loudspeaker drive signal, namely a loudspeaker drive signal d(x,t) that is a time signal, is obtained, as shown by the following Expression (16).

[Math. 16]

$$d(x, t) = \frac{2\pi e^{-\alpha y_{ref}} e^{-ik_{pw,z}z}}{K_0(\alpha y_{ref})}e^{-ik_{pw,x}x}e^{-i\omega_{pw}t} \tag{16}$$

At this time, if the loudspeaker constituting the loudspeaker array 23 is identified and the index indicating the position of the loudspeaker is represented by I, the filter coefficient h(l,m) of the audio filter of the loudspeaker having the index I is obtained from the expression (16), as shown by the following Expression (17).

[Math. 17]

$$h(l, m) = \frac{2\pi e^{-\alpha y_{ref}} e^{-ik_{pw,z}z}}{K_0(\alpha y_{ref})}e^{-ik_{pw,x}l}e^{-i\omega_{pw}m} \tag{17}$$

Note that in Expression (17), m represents a time index. The filter coefficient h(l,m) is obtained by replacing x in the loudspeaker drive signal d(x,t) shown in Expression (16) with the index l, and replacing t with the time index m. When a filtering process is applied to the sound source signal using such a filter coefficient h(l,m), windowing is performed in the spatial direction on the wave front formed on the basis of the sound source signal. Thereby, generation of side lobes, that is, propagating waves, can be reduced.

Furthermore, in the above description, description has been given on the method of obtaining an evanescent wave in the wave number area and calculating the filter coefficient h(l,m). However, a filter coefficient for generating an evanescent wave may be obtained by other methods.

(Filter Unit)

By performing calculation shown by the following Expression (18), the filter unit 22 convolves the filter coefficient h(l,m) of the audio filter supplied from the local sound field forming filter coefficient recording unit 21 and the sound source signal, and calculates the loudspeaker drive signal s(l,n) of each loudspeaker of the loudspeaker array 23. In other words, the loudspeaker drive signal s(l,n) is generated by applying a filtering process to the sound source signal using an audio filter including a filter coefficient h(l,m).

[Math. 18]

$$s(l, n) = \sum_{m=0}^{N} h(l, m)x(n-m) \tag{18}$$

Note that in Expression (18), n represents a time index, and x(n) represents a sound source signal. Furthermore, N indicates a filter length.

The filter unit 22 supplies the loudspeaker drive signal s(l,n) thus obtained to each of the loudspeakers constituting the loudspeaker array 23 to reproduce the sound.

<Description of Local Sound Field Forming Process>

Figure 9:
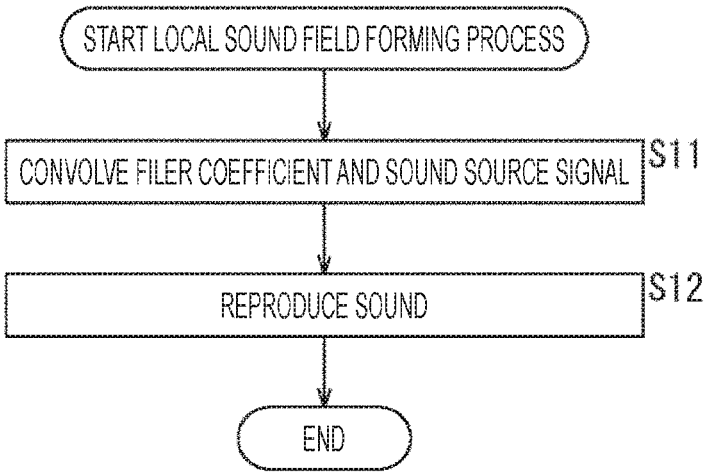
FIG. 9 is a flowchart for explaining a local sound field forming process.

Next, a local sound field forming process performed by the local sound field forming apparatus 11 will be described with reference to the flowchart of FIG. 9.

In step S11, the filter unit 22 reads out the filter coefficient h(l,m) of each loudspeaker from the local sound field forming filter coefficient recording unit 21, and convolves the readout filter coefficient h(l,m) and the supplied sound source signal for each loudspeaker, to thereby generate a loudspeaker drive signal s(l,n).

In step S11, the loudspeaker drive signal s(l,n) is generated by calculating the above-described Expression (18) for each loudspeaker constituting the loudspeaker array 23.

In step S12, the filter unit 22 supplies the generated loudspeaker drive signal s(l,n) to the loudspeaker constituting the loudspeaker array 23 to reproduce the sound, and the local sound field formation processing ends. As a result, a sound field is formed using the evanescent wave by the loudspeaker array 23, and a local sound field is formed.

As described above, the local sound field forming apparatus 11 generates a loudspeaker drive signal by using filter coefficients for windowing in the spatial direction, and reproduces the sound based on the loudspeaker drive signal by the loudspeaker array 23 including a directional loudspeaker as a component. With this configuration, it is possible to reduce sound leakage in an unintended direction.

Meanwhile, in a case where the number of loudspeakers constituting the loudspeaker array 23 is small or in a case where a high frequency sound with respect to the time frequency is to be reproduced in particular, a propagating wave leaks out in the x direction when the sound by the loudspeaker array 23 is reproduced on the basis of the loudspeaker drive signal obtained by the filter unit 22.

Figure 10:
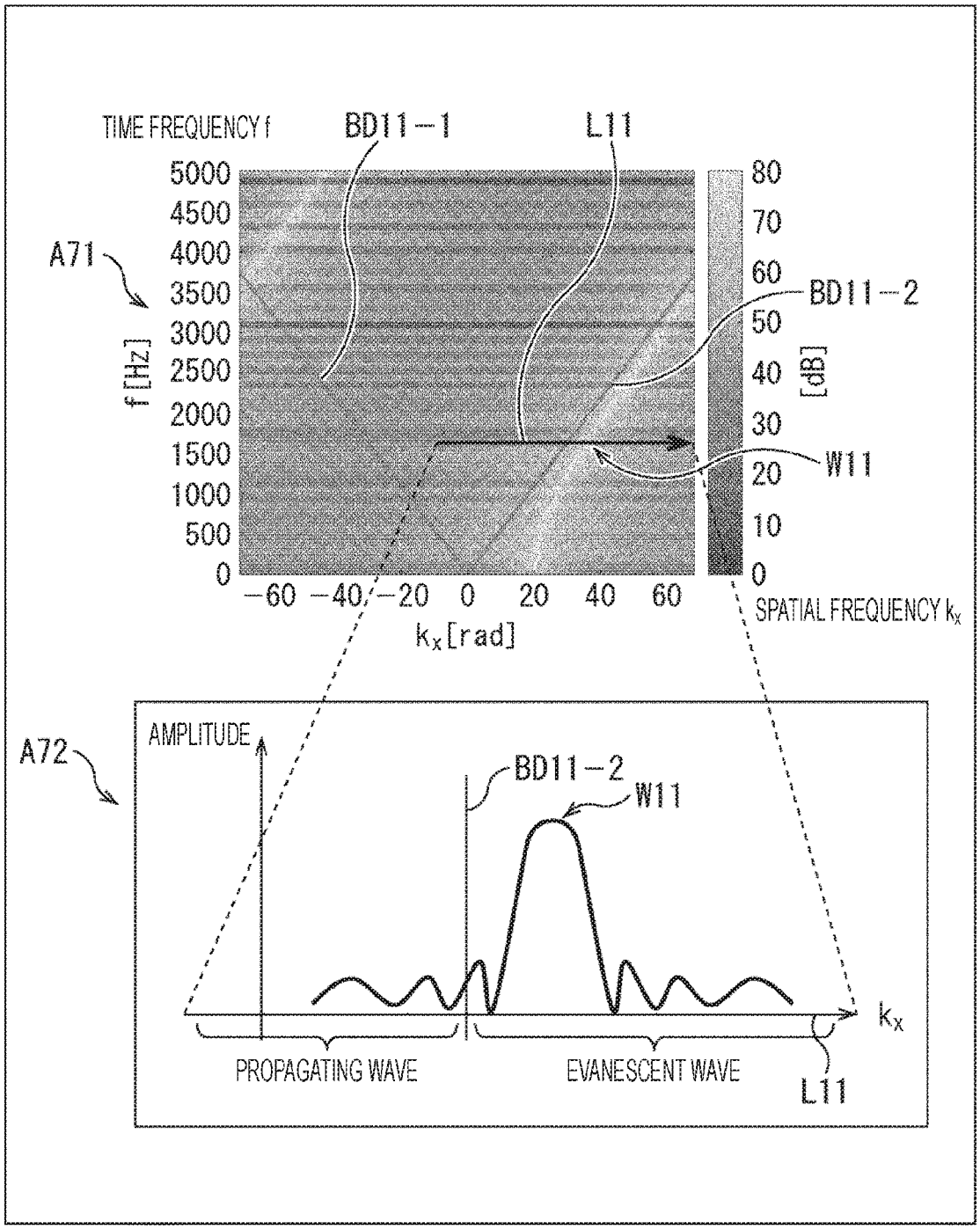
FIG. 10 is a diagram for explaining a spatial spectrum of a loudspeaker drive signal.

Here, FIG. 10 illustrates an example of a spatial spectrum of a loudspeaker drive signal for generating an evanescent wave.

In FIG. 10, a part indicated by an arrow A71 shows a spatial spectrum of a loudspeaker drive signal, namely a spatiotemporal spectrogram, and in particular, the horizontal axis shows the spatial frequency, that is, the wave number $k_x$ in the x direction, and the vertical axis shows the time frequency f. Moreover, the density in the spatial spectrum indicates the sound pressure (amplitude).

Note that in this case, in order to simplify the explanation, it is assumed that the wave number in the z direction is $k_z=0$, and that the loudspeakers constituting the loudspeaker array 23 are aligned linearly on the x axis.

In the spatial spectrum indicated by the arrow A71, a boundary BD11-1 and a boundary BD11-2 expressed by straight lines represent the boundary positions between the evanescent area and the propagating wave area, that is, evanescent boundaries.

In the local sound field forming apparatus 11, when the sound is reproduced on the basis of the loudspeaker drive signal s(l,n), a wave front of a spatial spectrum as indicated by the arrow A71 is generated. The generated wave includes an evanescent wave and a propagating wave.

At this time, an area on the right side of the boundary BD11-1 in the drawing and on the left side of the boundary BD11-2 in the drawing is a propagating wave area, and the wave in the propagating wave area is a propagating wave. On the other hand, an area on the left side of the boundary BD11-1 in the drawing and an area on the right side of the boundary BD11-2 in the drawing which are outside the evanescent boundaries are evanescent areas, and the wave in the evanescent area is an evanescent wave.

Note that in the following description, in a case where it is not necessary to particularly distinguish the boundary BD11-1 and the boundary BD11-2, it is simply referred to as a boundary BD11.

The boundary BD11 is a position where the wave number $k=(k_x^2+k_z^2)^{1/2}$, particularly in this example, the wave number $k_x$ satisfies $k_x=|\omega/c|$, and the wave at this position is a propagating wave traveling in the x direction.

Furthermore, a part indicated by an arrow A72 shows a relationship between a wave number $k_x$ of a predetermined area in the spatial spectrum indicated by the arrow A71, namely a part at the straight line L11, and the amplitude of a wave (sound wave) to be formed. In other words, in the part indicated by the arrow A72, the vertical axis shows the amplitude and the horizontal axis shows the wave number $k_x$.

In the example illustrated in FIG. 10, as is understood from the spatial spectrum indicated by the arrow A71, a portion indicated by an arrow W11 is observed as a spectrum peak. In other words, there is a spectrum peak along the boundary BD11-2, and the spectrum peak is located within the evanescent area.

Therefore, it is understood that the portion indicated by the arrow W11, that is, the spectrum peak portion in the wave front formed as indicated by the arrow A72 becomes the main lobe, and that when the sound is reproduced on the basis of the loudspeaker drive signal s(l,n), the evanescent wave is mainly generated.

In this manner, the peak of a spectrum representing the evanescent wave exists in the evanescent area which is outside the evanescent boundary and satisfies $|\omega/c|<|k_x|$. However, as the length in the x direction of the loudspeaker array 23 is finite, a truncation error occurs. As a result, it is understood that the side lobes of the spectrum leak into the propagating wave area satisfying $|k_x|<|\omega/c|$, which falls within the evanescent boundary, so that not only the evanescent wave but also the propagating wave is generated.

As described above, the influence of side lobes increases as the number of loudspeakers constituting the loudspeaker array 23 decreases. Further, in a case where a shown in Expression (11) represents a constant, the influence of side lobes increases as the time frequency becomes higher.

Therefore, in the local sound field forming apparatus 11, one or more loudspeakers among the loudspeakers constituting the loudspeaker array 23 are directional loudspeakers.

For example, as described above with reference to FIG. 4, by using a directional loudspeaker having directivity in the front direction, that is, the y direction, as one or more loudspeakers constituting the loudspeaker array 23, it is possible to reduce sound leakage in the x direction.

Figure 11:
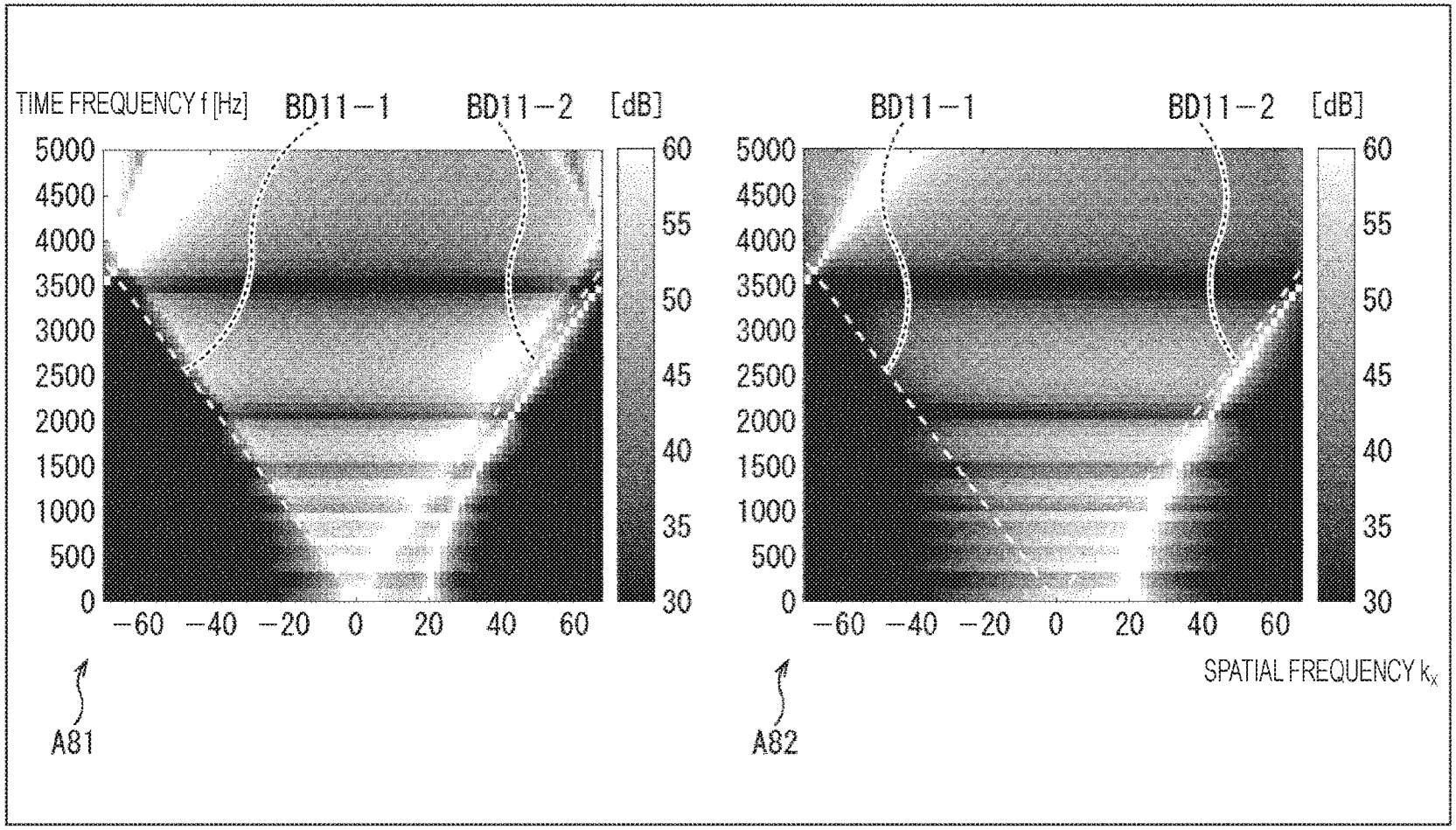
FIG. 11 is a diagram for explaining a spatial spectrum of a formed sound field.

Here, if all the loudspeakers constituting the loudspeaker array 23 are directional loudspeakers having directivity in the y direction, for example, the energy of the propagating wave area in the vicinity of the evanescent boundary in the formed sound field becomes small as illustrated in FIG. 11.

Note that in FIG. 11, parts corresponding to those in FIG. 10 are denoted by the same reference numerals, and the description thereof will be omitted as appropriate.

A part indicated by an arrow A81 in FIG. 11 shows a spatial spectrum of a sound field formed when all loudspeakers constituting the loudspeaker array 23 are omnidirectional loudspeakers, namely a spatiotemporal spectrogram. Furthermore, a part indicated by an arrow A82 shows a spatial spectrum of a sound field formed when all loudspeakers constituting the loudspeaker array 23 are directional loudspeakers, namely a spatiotemporal spectrogram. In particular, in these spatial spectra, the horizontal axis shows the spatial frequency, that is, the wave number $k_x$, and the vertical axis shows the time frequency f. Moreover, the density in the spatial spectrum indicates the sound pressure (energy).

In the spatial spectrum indicated by the arrow A81, a plane wave (propagating wave) propagating in the x direction, that is, the direction in which the loudspeakers are lined up in the loudspeaker array 23, is generated, because the energy of the propagating wave area in the vicinity of the boundary BD11 is large. That is, sound leakage in the x direction increases with respect to the loudspeaker array 23.

On the other hand, in the spatial spectrum indicated by the arrow A82, it is understood that the energy of the propagating wave area in the vicinity of the boundary BD11 is small, and sound leakage in the x direction is greatly reduced. This is because the influence of the side lobes leaking out to the vicinity of the boundary BD11, that is, the vicinity of the evanescent boundary, is reduced by using the directional loudspeaker.

Figure 12:
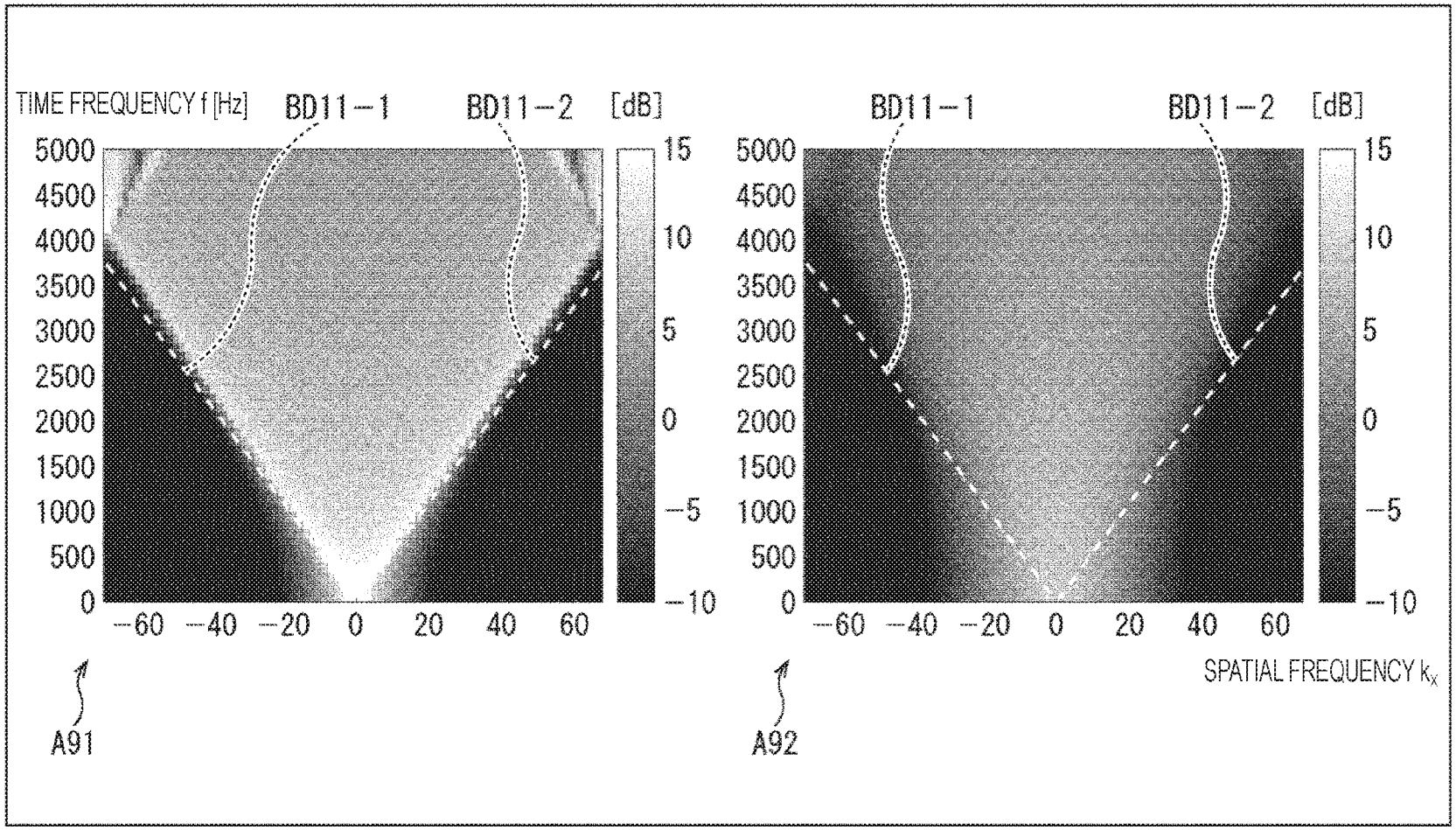
FIG. 12 is a diagram for explaining a spatial spectrum of a transfer characteristic of a loudspeaker array.

Furthermore, the phenomenon that the sound leakage in the x direction decreases when a directional loudspeaker is adopted as a loudspeaker constituting the loudspeaker array 23 can be confirmed also in the spatiotemporal spectrogram of a transfer characteristic of the loudspeaker array 23, as illustrated in FIG. 12, for example. Note that in FIG. 12, parts corresponding to those in FIG. 10 are denoted by the same reference numerals, and the description thereof will be omitted as appropriate.

A part indicated by an arrow A91 in FIG. 12 indicates a spatiotemporal spectrogram of the transfer characteristic of the loudspeaker array 23, namely a spatial spectrum, when all loudspeakers constituting the loudspeaker array 23 are omnidirectional loudspeakers. Furthermore, a part indicated by an arrow A92 shows a spatiotemporal spectrogram of the transfer characteristic of the loudspeaker array 23, namely a spatial spectrum, when all loudspeakers constituting the loudspeaker array 23 are directional loudspeakers. In particular, in these spatial spectra, the horizontal axis shows the spatial frequency, that is, the wave number $k_x$, and the vertical axis shows the time frequency f. Moreover, the density in the spatial spectrum indicates the sound pressure (energy).

In the spatial spectrum indicated by the arrow A91, it is understood that a signal propagating to the propagating wave area in the vicinity of the evanescent boundary which is the boundary BD11, that is, in the x direction, has constant energy.

On the other hand, in the spatial spectrum indicated by the arrow A92, it is understood that in the propagating wave area in the vicinity of the evanescent boundary which is the boundary BD11, the energy of a signal is smaller even in the same area, compared with the case in the spatial spectrum indicated by the arrow A91.

As described above, by using a directional loudspeaker as one or more of the loudspeakers constituting the loudspeaker array 23, it is possible to significantly reduce the sound leakage in an unintended direction as compared with the case of using the loudspeaker array only configured of omnidirectional loudspeakers.

<Exemplary Configuration of Computer>

Incidentally, the series of processes described above can be executed by hardware or executed by software. In a case where a series of processes is executed by software, a program constituting the software is installed in the computer. Here, the computer includes a computer incorporated in dedicated hardware, and a general-purpose computer or the like capable of executing various functions by installing various programs, for example.

Figure 13:
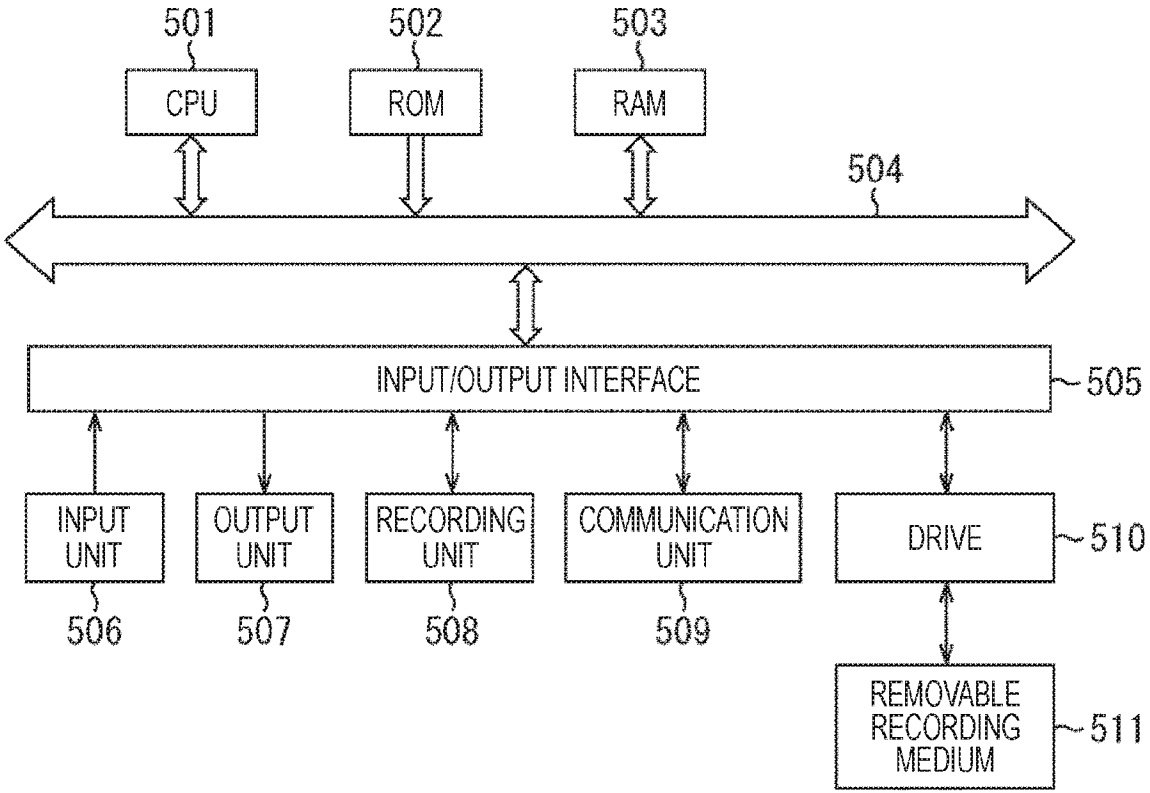
FIG. 13 is a diagram illustrating an exemplary configuration of a computer.

FIG. 13 is a block diagram illustrating an exemplary configuration of hardware of a computer that executes the above-described series of processes by a program.

In a computer, a central processing unit (CPU) 501, a read only memory (ROM) 502, and a random access memory (RAM) 503 are mutually connected by a bus 504.

The bus 504 is further connected with an input/output interface 505. The input/output interface 505 is connected with an input unit 506, an output unit 507, a recording unit 508, a communication unit 509, and a drive 510.

The input unit 506 includes a keyboard, a mouse, a microphone, an imaging device, and the like. The output unit 507 includes a display, a loudspeaker array, and the like. The recording unit 508 includes a hard disk, a nonvolatile memory, and the like. The communication unit 509 includes a network interface and the like. The drive 510 drives a removable recording medium 511 such as a magnetic disk, an optical disk, a magneto-optical disk, or a semiconductor memory.

In the computer configured as described above, the CPU 501 loads, for example, a program recorded in the recording unit 508 into the RAM 503 via the input/output interface 505 and the bus 504 and executes the program, whereby the series of processes described above is performed.

A program to be executed by the computer (CPU 501) can be provided by being recorded on a removable recording medium 511 as a package medium or the like, for example. Furthermore, the program can be provided via a wired or wireless transmission medium such as a local area network, the Internet, or digital satellite broadcasting.

In the computer, the program can be installed on the recording unit 508 via the input/output interface 505 by mounting the removable recording medium 511 on the drive 510. Furthermore, the program can be received by the communication unit 509 via a wired or wireless transmission medium and installed on the recording unit 508. In addition, the program can be installed on the ROM 502 or the recording unit 508 in advance.

It is to be noted that the program executed by the computer may be a program which is processed in chronological order according to the order described in the present specification, or may be executed in parallel or at necessary timing such as when a call being made.

Furthermore, embodiments of the present technology are not limited to the above-described embodiments. Various modifications can be made without departing from the gist of the present technology.

For example, in the present technology, it is possible to adopt a configuration of cloud computing in which one function is shared by a plurality of apparatuses via a network, and is collaboratively processed.

Furthermore, each step described in the above-described flowchart can be executed by one apparatus or shared by a plurality of apparatuses.

Moreover, in a case where a plurality of processes are included in one step, the plurality of processes included in the one step can be executed by one apparatus or shared by a plurality of apparatuses.

Furthermore, the effects described in in the present specification are merely examples and are not limited, and other effects may also be provided.

Moreover, the present technology may be configured as described below.

(1)

A local sound field forming apparatus including:

a local sound field forming filter coefficient recording unit configured to record an audio filter coefficient for forming a sound field by an evanescent wave;

a filter unit configured to convolve the audio filter coefficient and a sound source signal to generate a loudspeaker drive signal; and a loudspeaker array including a plurality of loudspeakers including a directional loudspeaker, the loudspeaker array being configured to reproduce a sound on the basis of the loudspeaker drive signal.

(2)

The local sound field forming apparatus according to (1), in which the directional loudspeaker is a flat loudspeaker or a plane wave loudspeaker.

(3)

The local sound field forming apparatus according to (1) or (2), in which the loudspeaker array is a linear loudspeaker array or a flat loudspeaker array.

(4)

The local sound field forming apparatus according to any one of (1) to (3), in which at least half of the plurality of the loudspeakers included in the loudspeaker array are the directional loudspeakers.

(5)

A local sound field forming method implemented by a local sound field forming apparatus, the apparatus including:

a local sound field forming filter coefficient recording unit configured to record an audio filter coefficient for forming a sound field by an evanescent wave;

a filter unit configured to convolve the audio filter coefficient and a sound source signal to generate a loudspeaker drive signal; and a loudspeaker array including a plurality of loudspeakers including a directional loudspeaker, the loudspeaker array being configured to reproduce a sound on the basis of the loudspeaker drive signal, the method including steps of:

generating the loudspeaker drive signal by the filter unit; and reproducing the sound on the basis of the loudspeaker drive signal by the loudspeaker array.

(6)

A program for causing a computer to execute a process, the computer being configured to control a local sound field forming apparatus including:

a local sound field forming filter coefficient recording unit configured to record an audio filter coefficient for forming a sound field by an evanescent wave;

a filter unit configured to convolve the audio filter coefficient and a sound source signal to generate a loudspeaker drive signal; and a loudspeaker array including a plurality of loudspeakers including a directional loudspeaker, the loudspeaker array being configured to reproduce a sound on the basis of the loudspeaker drive signal, the process including steps of:

generating the loudspeaker drive signal by the filter unit; and reproducing the sound on the basis of the loudspeaker drive signal by the loudspeaker array.

REFERENCE SIGNS LIST

11 Local sound field forming apparatus
21 Local sound field forming filter coefficient recording unit
22 Filter unit
23 Loudspeaker array

The invention claimed is:

1. A local sound field forming apparatus, comprising:

a local sound field forming filter coefficient recording unit configured to record an audio filter coefficient;

a filter unit configured to:

convolve the audio filter coefficient and a sound source signal; and generate a loudspeaker drive signal based on a result of the convolution; and a loudspeaker array including a plurality of loudspeakers, wherein the plurality of loudspeakers is a combination of a plurality of omnidirectional loudspeakers and a plurality of directional loudspeakers, the plurality of omnidirectional loudspeakers and the plurality of directional loudspeakers are alternately arranged in the loudspeaker array, and the loudspeaker array is configured to reproduce a sound based on the loudspeaker drive signal.

2. The local sound field forming apparatus according to claim 1, wherein each directional loudspeaker of the plurality of directional loudspeakers is one of a flat loudspeaker or a plane wave loudspeaker.

3. The local sound field forming apparatus according to claim 1, wherein the loudspeaker array is one of a linear loudspeaker array or a flat loudspeaker array.

4. The local sound field forming apparatus according to claim 1, wherein at least half of the plurality of loudspeakers of the loudspeaker array constitutes the plurality of directional loudspeakers.

5. A local sound field forming method, comprising:

in a local sound field forming apparatus:

recording, by a local sound field forming filter coefficient recording unit of the local sound field forming apparatus, an audio filter coefficient;

convolving, by a filter unit of the local sound field forming apparatus, the audio filter coefficient and a sound source signal;

generating, by the filter unit, a loudspeaker drive signal based on a result of the convolution; and reproducing, by a loudspeaker array of the local sound field forming apparatus, a sound based on the loudspeaker drive signal, wherein the loudspeaker array includes a plurality of loudspeakers, the plurality of loudspeakers is a combination of a plurality of omnidirectional loudspeakers and a plurality of directional loudspeakers, and the plurality of omnidirectional loudspeakers and the plurality of directional loudspeakers are alternately arranged in the loudspeaker array.

6. A non-transitory computer-readable medium having stored thereon, computer-executable instructions which, when executed by a computer, cause the computer to execute operations to control a local sound field forming apparatus, the operations comprising:

recording an audio filter coefficient;

convolving the audio filter coefficient and a sound source signal;

generating a loudspeaker drive signal based on a result of the convolution; and reproducing, by a loudspeaker array of the local sound field forming apparatus, a sound based on the loudspeaker drive signal, wherein the loudspeaker array includes a plurality of loudspeakers, the plurality of loudspeakers is a combination of a plurality of omnidirectional loudspeakers and a plurality of directional loudspeakers, and the plurality of omnidirectional loudspeakers and the plurality of directional loudspeakers are alternately arranged in the loudspeaker array.

* * * * *